US006938985B2

(12) United States Patent
Ottenheimer et al.

(10) Patent No.: US 6,938,985 B2
(45) Date of Patent: Sep. 6, 2005

(54) SLOTTED SUBSTRATE AND METHOD OF MAKING

(75) Inventors: Thomas H. Ottenheimer, Philomath, OR (US); Martha A. Truninger, Corvallis, OR (US); Jeffrey S. Obert, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 4 days.

(21) Appl. No.: 10/601,150

(22) Filed: Jun. 20, 2003

(65) Prior Publication Data

US 2004/0021743 A1 Feb. 5, 2004

Related U.S. Application Data

(63) Continuation of application No. 10/209,408, filed on Jul. 30, 2002, now abandoned.

(51) Int. Cl.[7] ..... B41J 2/135; B41J 2/015
(52) U.S. Cl. ..... 347/44; 347/20
(58) Field of Search ..... 347/20, 40–44, 347/54, 56, 61–64, 92–94

(56) References Cited

U.S. PATENT DOCUMENTS

| | | | |
|---|---|---|---|
| 4,915,718 | A | 4/1990 | Desai |
| 5,066,357 | A | 11/1991 | Smyth, Jr. et al. |
| 5,317,346 | A | 5/1994 | Garcia |
| 5,361,087 | A | 11/1994 | Tajima et al. |
| 5,378,137 | A | 1/1995 | Asakawa et al. |
| 5,441,593 | A | 8/1995 | Baughman et al. |
| 5,449,630 | A | 9/1995 | Lur et al. |
| 5,537,133 | A | 7/1996 | Marler et al. |
| 5,588,597 | A | 12/1996 | Reinecke et al. |
| 5,658,471 | A | 8/1997 | Murthy et al. |
| 5,719,604 | A | 2/1998 | Inui et al. |
| 5,786,988 | A | 7/1998 | Harari |
| 5,820,919 | A | 10/1998 | Terai |
| 5,847,725 | A | 12/1998 | Cleland et al. |
| 5,867,189 | A | 2/1999 | Whitlow et al. |
| 5,910,679 | A | 6/1999 | Kim |
| 5,953,029 | A | 9/1999 | Keefe et al. |
| 5,988,786 | A | 11/1999 | Waller et al. |
| 6,020,270 | A | 2/2000 | Wong et al. |
| 6,106,096 | A | 8/2000 | Komplin et al. |
| 6,107,158 | A | 8/2000 | Zheng et al. |
| 6,133,926 | A | 10/2000 | Kawai et al. |
| 6,142,611 | A | 11/2000 | Pan |
| 6,184,570 | B1 | 2/2001 | MacDonald, Jr. et al. |
| 6,315,397 | B2 | 11/2001 | Truninger et al. |
| 6,331,055 | B1 | 12/2001 | Miller et al. |
| 6,348,396 | B1 | 2/2002 | Ishitsuka et al. |
| 6,360,439 | B1 | 3/2002 | Cleland et al. |
| 2001/0023979 | A1 | 9/2001 | Brouvillette et al. |

FOREIGN PATENT DOCUMENTS

| | | | |
|---|---|---|---|
| JP | 403215043 | A | 9/1991 |
| JP | 407009682 | A | 1/1995 |
| JP | 408001927 | A | 1/1996 |
| JP | 408142327 | A | 6/1996 |
| JP | 410193598 | A | 7/1998 |
| JP | 411020177 | A | 1/1999 |
| JP | 2000006409 | | 1/2000 |
| JP | 2000141646 | | 5/2000 |
| JP | 2000246363 | | 9/2000 |

*Primary Examiner*—Stephen Meier
*Assistant Examiner*—An H. Do

(57) ABSTRACT

The described embodiments relate to a slotted substrate for use in a fluid ejecting device. One embodiment includes a substrate, and a slot received in the substrate. The slot has a central region and one or more terminal region(s). The central region extends at least in part along a pair of sidewalls. Individual terminal region(s) being defined by a terminal sidewall at least a portion of which extends away from both sidewalls of the central region.

31 Claims, 8 Drawing Sheets

SLOTTED SUBSTRATE AND METHOD OF MAKING

RELATED CASES

This patent application is a continuation claiming priority from a patent application having Ser. No. 10/209,408 titled "Slotted Substrate and Method of Making" filed Jul. 30, 2002, now abandoned.

BACKGROUND

Inkjet printers and other printing devices have become ubiquitous in society. These printing devices can utilize a slotted substrate to deliver ink in the printing process. Such printing devices can provide many desirable characteristics at an affordable price. However, the desire for ever more features at ever-lower prices continues to press manufacturers to improve efficiencies. Consumers want ever higher print image resolution, realistic colors, and increased print speed.

One way of achieving consumer demands is by improving the slotted substrates that are incorporated into fluid ejecting devices, printers and other printing devices. Currently, the slotted substrates can have a propensity to crack and ultimately break. This can increase production costs and decrease product reliability.

Accordingly, the present invention arose out of a desire to provide slotted substrates having desirable characteristics.

BRIEF DESCRIPTION OF THE DRAWINGS

The same components are used throughout the drawings to reference like features and components.

DETAILED DESCRIPTION

Overview

The embodiments described below pertain to methods and systems for forming slots in a substrate. Several embodiments of this process will be described in the context of forming fluid feed slots in a substrate that can be incorporated into a print head die or other fluid ejecting device.

As commonly used in print head dies, the substrate can comprise a semiconductor substrate that can have microelectronics incorporated within, deposited over, and/or supported by the substrate on a thin-film surface that can be opposite a back surface or backside. The fluid feed slot(s) can allow fluid, commonly ink, to be supplied from an ink supply or reservoir to fluid ejecting elements contained in ejection chambers within the print head.

In some embodiments, this can be accomplished by connecting the fluid feed slot to one or more ink feed passageways, each of which can supply an individual ejection chamber. The fluid ejecting elements commonly comprise heating elements or firing resistors that heat fluid causing increased pressure in the ejection chamber. A portion of that fluid can be ejected through a firing nozzle with the ejected fluid being replaced by fluid from the fluid feed slot.

The fluid feed slots are advantageously configured to reduce stress concentrations and resultant cracking of the substrate. In some embodiments, the slots can comprise a central region and at least one terminal region joined with the central region. In other embodiments, the central region can be defined at least in part by two generally parallel sidewalls. Some exemplary embodiments can have terminal sub-regions or portions that lie outside of a space defined by generally parallel planes that extend along the sidewalls of the central region. Other exemplary embodiments can utilize a terminal region that has portions that extend away from the sidewalls of the central region. The various configurations can, among other factors, reduce the concentration of stress in the substrate material resulting in a stronger slotted substrate.

Exemplary Printer System

Figure 1:
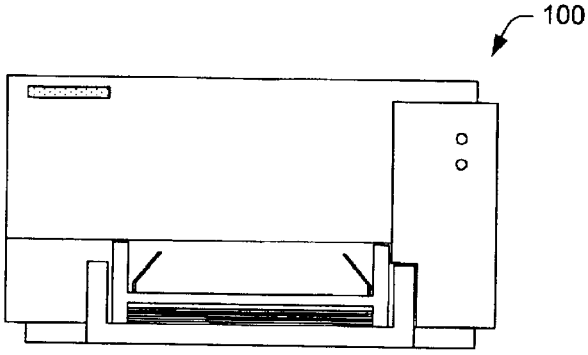
FIG. 1 shows a front elevational view of an exemplary printer.

FIG. 1 shows one embodiment of a printer 100 that can utilize an exemplary slotted substrate. The printer shown here is embodied in the form of an inkjet printer. The printer 100 can be, but need not be, representative of an inkjet printer series manufactured by the Hewlett-Packard Company under the trademark "DeskJet". The printer 100 can be capable of printing in black-and-white and/or in black-and-white as well as color. The term "printer" refers to any type of printer or printing device that ejects fluid such as ink or other pigmented materials onto a print media. Though an inkjet printer is shown for exemplary purposes, it is noted that aspects of the described embodiments can be implemented in other forms of image forming devices that employ slotted substrates, such as facsimile machines, photocopiers, and other fluid ejecting devices.

Figure 2:
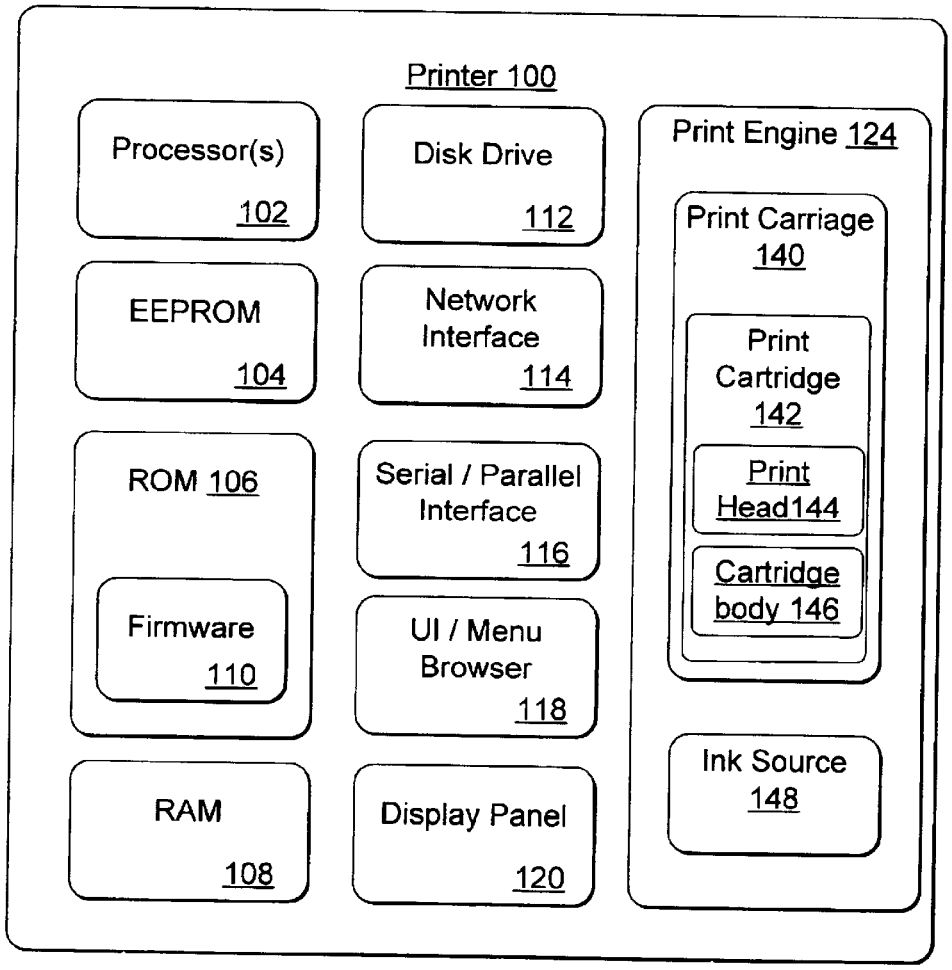
FIG. 2 shows a block diagram that illustrates various components of an exemplary printer.

FIG. 2 illustrates various components in one embodiment of printer 100 that can be utilized to implement the inventive techniques described herein. Printer 100 can include one or more processor(s) 102. The processor 102 can control various printer operations, such as media handling and carriage movement for linear positioning of the print head over a print media (e.g., paper, transparency, etc.).

Printer 100 can have an electrically erasable programmable read-only memory (EEPROM) 104, ROM 106 (non-erasable), and/or a random access memory (RAM) 108. Although printer 100 is illustrated having an EEPROM 104 and ROM 106, a particular printer may only include one of the memory components. Additionally, although not shown, a system bus typically connects the various components within the printing device 100.

The printer 100 can also have a firmware component 110 that is implemented as a permanent memory module stored on ROM 106, in one embodiment. The firmware 110 is programmed and tested like software, and is distributed with the printer 100. The firmware 110 can be implemented to coordinate operations of the hardware within printer 100 and contains programming constructs used to perform such operations.

In this embodiment, processor(s) 102 processes various instructions to control the operation of the printer 100 and to communicate with other electronic and computing devices. The memory components, EEPROM 104, ROM 106, and RAM 108, store various information and/or data such as configuration information, fonts, templates, data being printed, and menu structure information. Although not shown in this embodiment, a particular printer can also include a flash memory device in place of or in addition to EEPROM 104 and ROM 106.

Printer 100 can also include a disk drive 1 12, a network interface 114, and a serial/parallel interface 116 as shown in the embodiment of FIG. 2. Disk drive 112 provides additional storage for data being printed or other information maintained by the printer 100. Although printer 100 is illustrated having both RAM 108 and a disk drive 112, a particular printer may include either RAM 108 or disk drive 112, depending on the storage needs of the printer. For example, an inexpensive printer may include a small amount of RAM 108 and no disk drive 112, thereby reducing the manufacturing cost of the printer.

Network interface 114 provides a connection between printer 100 and a data communication network in the embodiment shown. The network interface 114 allows devices coupled to a common data communication network to send print jobs, menu data, and other information to printer 100 via the network. Similarly, serial/parallel interface 116 provides a data communication path directly between printer 100 and another electronic or computing device. Although printer 100 is illustrated having a network interface 114 and serial/parallel interface 116, a particular printer may only include one interface component.

Printer 100 can also include a user interface and menu browser 118, and a display panel 120 as shown in the embodiment of FIG. 2. The user interface and menu browser 118 allows a user of the printer 100 to navigate the printer's menu structure. User interface 118 can be indicators or a series of buttons, switches, or other selectable controls that are manipulated by a user of the printer. Display panel 120 is a graphical display that provides information regarding the status of the printer 100 and the current options available to a user through the menu structure.

This embodiment of printer 100 also includes a print engine 124 that includes mechanisms arranged to selectively apply fluid (e.g., liquid ink) to a print media such as paper, plastic, fabric, and the like in accordance with print data corresponding to a print job.

The print engine 124 can comprise a print carriage 140. The print carriage can contain one or more print cartridges 142 that comprise a print head 144 and a print cartridge body 146. Additionally, the print engine can comprise one or more fluid sources 148 for providing fluid to the print cartridges and ultimately to a print media via the print heads.

Exemplary Embodiments

Figure 4:
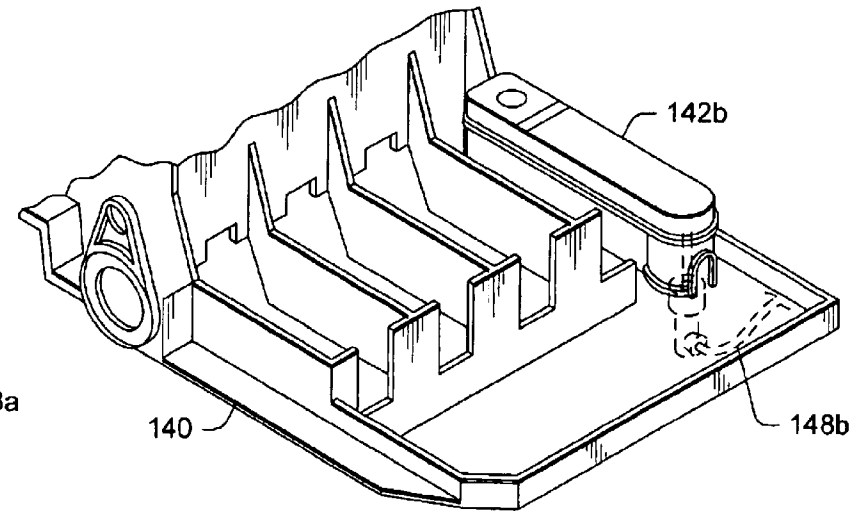
FIGS. 3 and 4 each show a perspective view of a print carriage in accordance with one exemplary embodiment.
Figure 3:
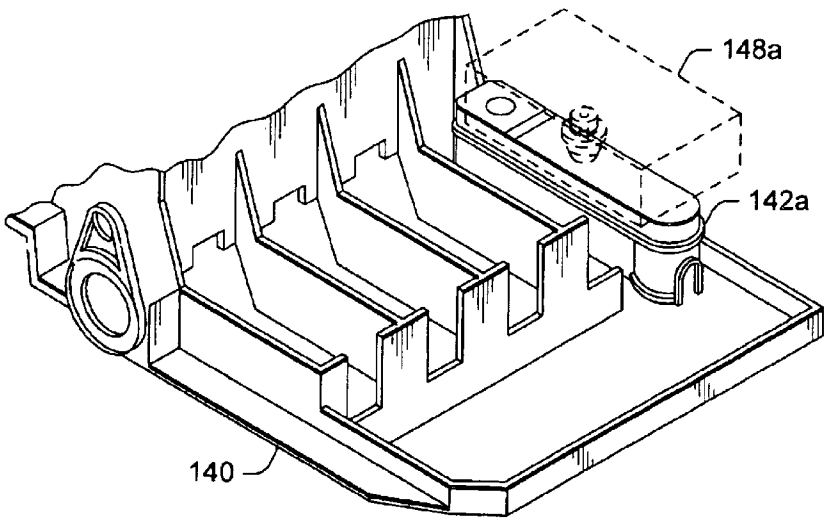

FIGS. 3 and 4 show exemplary print cartridges (142*a* and 142*b*) in a print carriage 140 as can be utilized in some embodiments of printer 100. The print carriages depicted are configured to hold four print cartridges although only one print cartridge is shown. Many other exemplary configurations are possible. FIG. 3 shows the print cartridge 142*a* configured for an up connect to a fluid source 148*a*, while FIG. 4 shows print cartridge 142*b* configured to down connect to a fluid source 148*b*. Other exemplary configurations are possible including but not limited the print cartridge having its own self-contained fluid supply.

Figure 5:
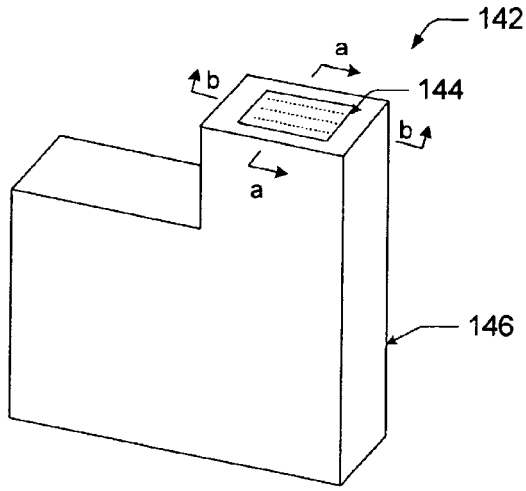
FIG. 5 shows a perspective view of a print cartridge in accordance with one exemplary embodiment.

FIG. 5 shows an exemplary print cartridge 142. The print cartridge is comprised of a print head 144 and a cartridge body 146 that supports the print head. Other exemplary configurations will be recognized by those of skill in the art.

Figure 6:
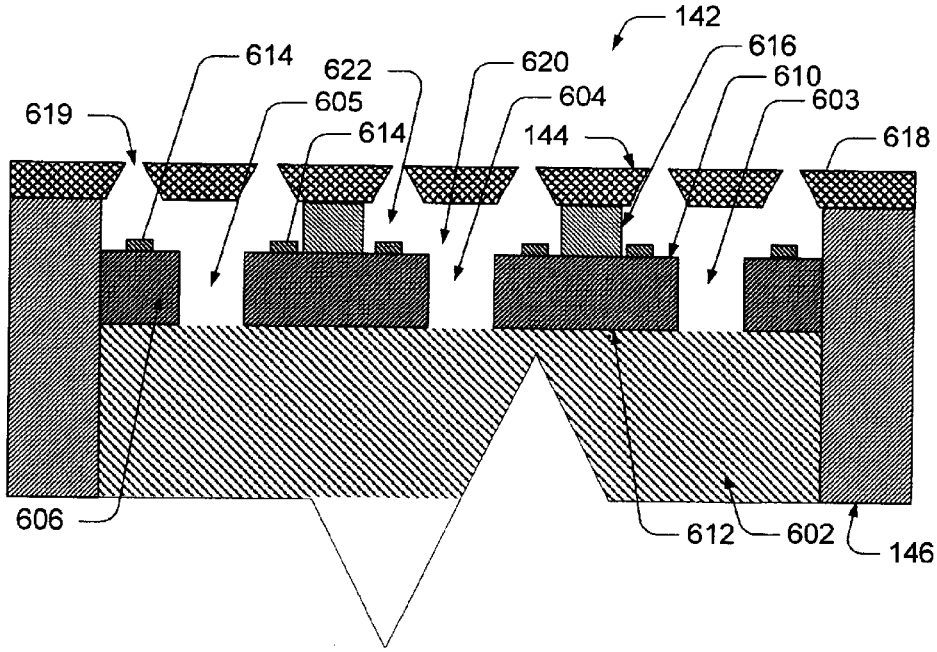
FIG. 6 shows a cross-sectional view of a top portion of a print cartridge in accordance with one exemplary embodiment.

FIG. 6 shows a cross-sectional representation of a portion of the exemplary print cartridge 142 taken along line a—a in FIG. 5. It shows the cartridge body 146 containing fluid 602 for supply to the print head 144. In this embodiment, the print cartridge is configured to supply one color of fluid or ink to the print head. In other embodiments, as described above, other exemplary print cartridges can supply multiple colors and/or black ink to a single print head. Other printers can utilize multiple print cartridges each of which can supply a single color or black ink. In this embodiment, a number of different fluid feed slots are provided, with three exemplary slots being shown at 603, 604, and 605. Other exemplary embodiments can divide the fluid supply so that each of the three fluid feed slots receives a separate fluid supply. Other exemplary print heads can utilize less or more slots than the three shown here.

The various fluid feed slots 603–605 pass through portions of a substrate 606. In this exemplary embodiment, silicon can be a suitable substrate. In some embodiments, substrate 606 comprises a crystalline substrate such as monocrystalline silicon or polycrystalline silicon. Examples of other suitable substrates include, among others, gallium arsenide, glass, silica, ceramics, or a semi-conducting material. The substrate can comprise various configurations as will be recognized by one of skill in the art.

The exemplary embodiments can utilize substrate thicknesses ranging from less than 100 microns to more than 10,000 microns. One exemplary embodiment can utilize a substrate 606 that is approximately 675 microns thick.

The substrate 606 has a first surface 610 and a second surface 612. Positioned above the substrate are the independently controllable fluid ejecting elements or fluid drop generators that in this embodiment comprise firing resistors 614. In this exemplary embodiment, the resistors are part of a stack of thin film layers on top of the substrate 606. The thin film layers can further comprise a barrier layer 616.

The barrier layer 616 can comprise, among other things, a photo-resist polymer substrate. Above the barrier layer is an orifice plate 618 that can comprise, but is not limited to a nickel substrate. The orifice plate can have a plurality of nozzles 619 through which fluid heated by the various resistors can be ejected for printing on a print media (not shown). The various layers can be formed, deposited, or attached upon the preceding layers. The configuration given here is but one possible configuration. For example, in an alternative embodiment, the orifice plate and barrier layer are integral.

The exemplary print cartridge shown in FIGS. 5 and 6 is upside down from the common orientation during usage. When positioned for use, fluid can flow from the cartridge body 146 into one or more of the slots 603–605. From the slots, the fluid can travel through a fluid feed passageway 620 that leads to an ejection chamber 622.

An ejection chamber can be comprised of a firing resistor, a nozzle, and a given volume of space therein. Other configurations are also possible. When an electrical current is passed through the resistor in a given ejection chamber, the fluid can be heated to its boiling point so that it expands to eject a portion of the fluid from the nozzle 619. The ejected fluid can then be replaced by additional fluid from the fluid feed passageway 620. Various embodiments can also utilize other ejection mechanisms.

Figure 7:
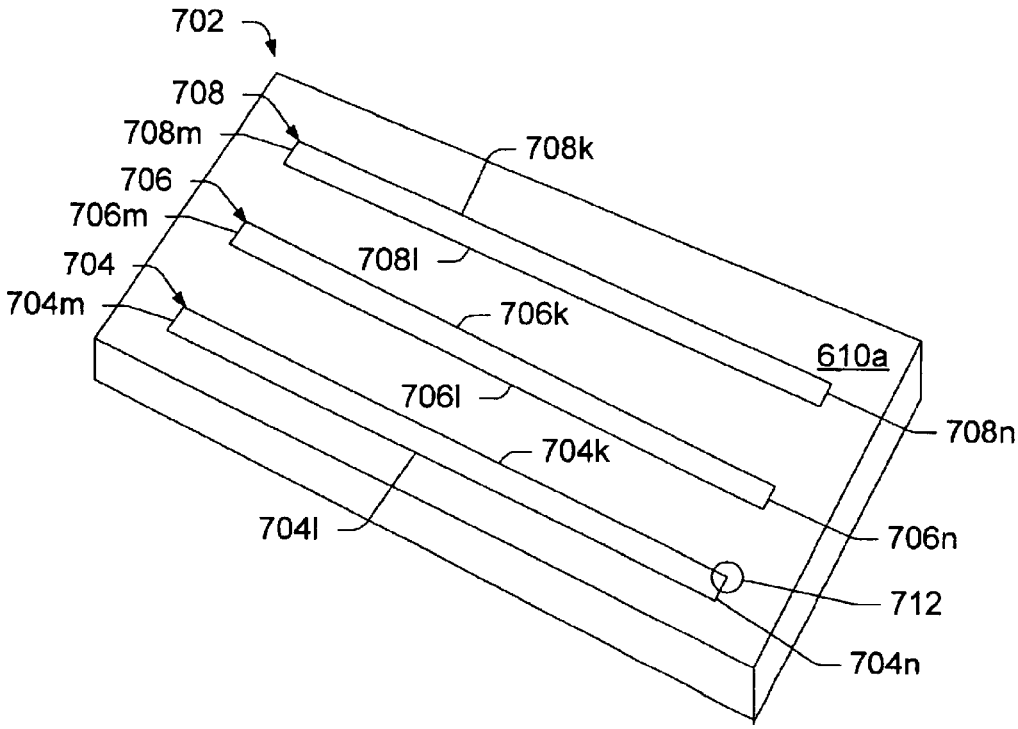
Fig. 7 Prior Art
FIG. 7 shows a perspective view of a prior art substrate.

FIG. 7 shows a prior art substrate 702 that has three slots 704, 706 and 708 formed therein. Individual slots can typically have a generally rectangular configuration when viewed from above a first surface 610*a* of the substrate. Each slot can have two sidewalls, designated "k" and "l" and two end walls, designated "m" and "n". The generally rectangular slot configuration can concentrate stresses on the substrate material at the ends of the slots. The stresses can be particularly concentrated on the substrate material at a region or corner where a sidewall meets an end wall. One of these corners is designated as 712.

Figure 7A:
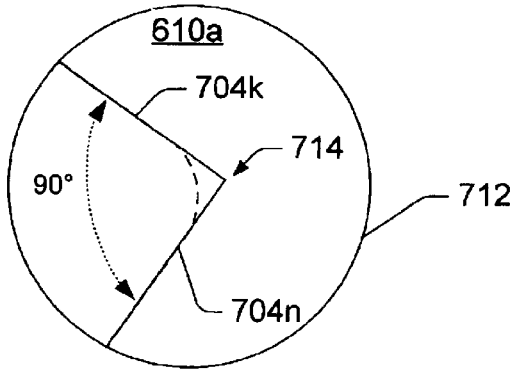
Fig. 7a Prior Art
FIG. 7*a* shows an expanded view of a portion of the prior art substrate shown in FIG. 7.

FIG. 7*a* shows an expanded view of corner 712. The end wall 704*n* is generally perpendicular to the sidewall 704*k*, and the intersection of the two walls can form an approximately 90-degree corner. Some slots can be slightly rounded at the corners (as shown in dashed lines), but still maintain the general configuration. Such slots have a relatively small radius of curvature between the end wall and the side wall. This configuration can cause particular regions of the substrate material to be subjected to high stress concentration. One such region of substrate material is indicated generally at 714. Stress concentrations in these regions can cause cracks to form.

For example, this problem can be especially prevalent where the side and end walls are formed along <110> crystalline planes of the substrate. When the slot walls are formed along <110> planes, the substrate can be prone to crack where the two <110> planes meet in the corner. Commonly, the cracks can initiate on any other <110> plane that intersects the corner region. Commonly, such cracks can propagate and ultimately cause the substrate's failure. Since the slotted substrate is commonly incorporated into a print cartridge or other fluid ejecting device, a failure of the substrate can cause the entire device to fail.

Figure 8:
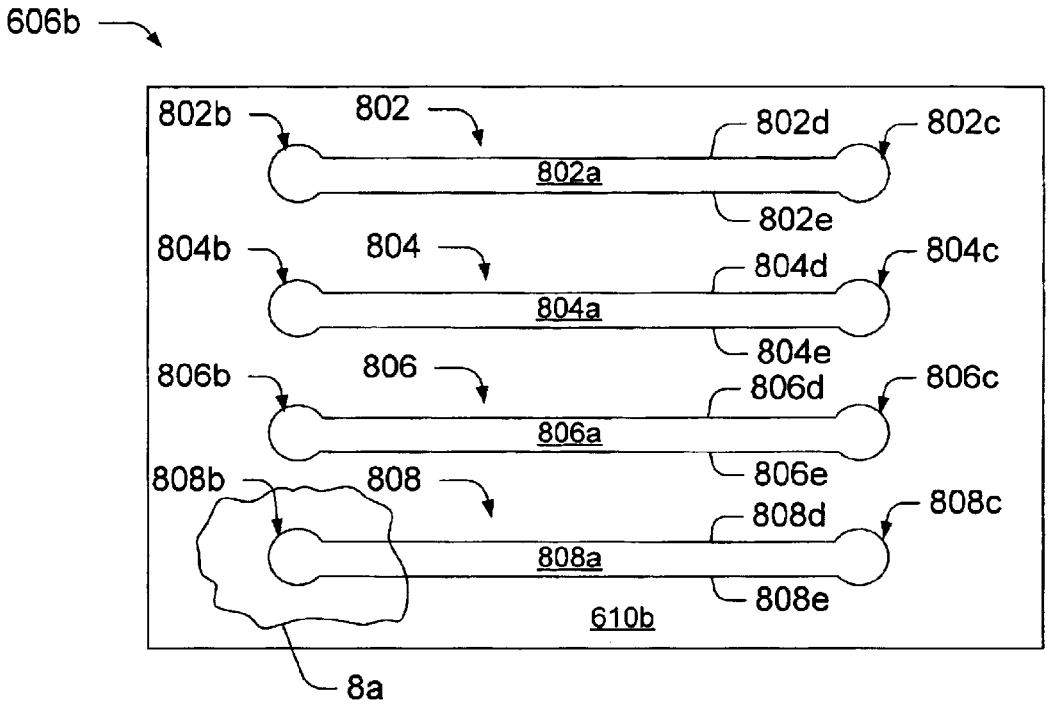
FIG. 8 shows a top view of an exemplary substrate in accordance with one exemplary embodiment.

FIG. 8 shows an exemplary slotted substrate 606*b* in accordance with one embodiment. The slotted substrate shown here can have a reduced propensity to crack when compared to existing slots. The substrate has four exemplary ink feed slot portions (802, 804, 806, and 808) formed therein. In this exemplary embodiment, the slot portions pass all the way through the substrate and so will be referred to as "slots", though such need not be the case.

As shown here, the slots are formed or received in the substrate's first surface 610*b*. In various embodiments, the first surface can comprise a thin-film surface or backside surface among others. Each slot can have a central region designated 802*a*–808*a* and one or more terminal or end regions. In this embodiment, there are two terminal regions on each slot. The terminal regions are designated respectively 802*b*–808*b* and 802*c*–808*c*.

The central region of each slot can comprise, at least in part, two sidewalls. Individual sidewalls are designated 802*d*–808*d* and 802*e*–808*e*. In this embodiment, each slot comprises a pair of sidewalls.

Figure 8A:
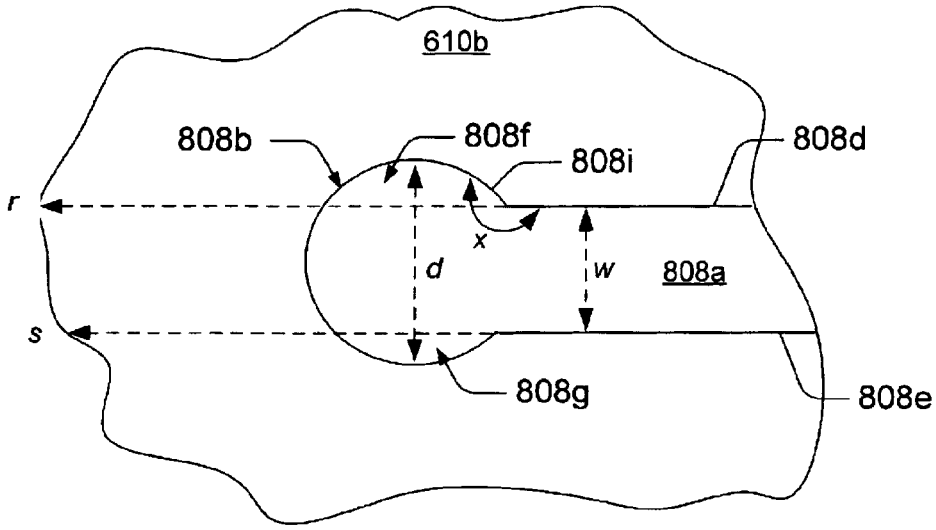
FIG. 8*a* is an expanded view of a portion of the exemplary substrate shown in FIG. 8.

FIG. 8*a* is an expanded view of a portion of slot 808 shown in FIG. 8. In this embodiment, the two sidewalls (808*d* and 808*e*) lie along individual planes (represented by dashed lines r and s respectively that extend into and out of the page upon which FIG. 8*a* appears), though such need not be the case. As shown here, the two planes can be generally parallel and are generally orthogonal to the first surface of the substrate, though such not need be the case. As shown, the two individual planes define a space therebetween, and the terminal region 808*b* comprises one or more sub-regions that lie outside of this space. As shown in FIG. 8*a*, the terminal region 808*b* has a first sub-region 808*f* and a second sub-region 808*g* that lie outside of the space defined by the planes. Other embodiments can have more or less sub-regions that lie outside of the space defined by the planes.

As shown in FIG. 8*a*, the terminal region 808*b* has a generally elliptical configuration or shape. In this embodiment, the elliptical shape comprises a circular shape. The terminal region can have a diameter d that is greater than a width w that extends between the sidewalls of the central region where the direction of the diameter is generally parallel to the direction of the width. Viewed another way, diameter d being equivalent to two times a radius can define a radius of curvature of the terminal region. In this exemplary embodiment, the radius of curvature can be greater than one half the width w of the central region. This relatively large radius of curvature can disperse loads over a greater amount of the substrate material, which results in lower stress concentrations than previous designs. Among other factors, this stress dispersal can reduce the propensity of the slotted substrate to crack.

As shown in FIG. 8*a*, the terminal region can also include, or be defined by, a sidewall 808*i* that intersects a central region sidewall 808*d* at an angle x greater than 180 degrees. This can reduce the stress concentrations on a particular region of the substrate material, e.g. at the ends of the slot. This stress dispersal can be especially effective when the slot is formed along <110> planes of the substrate.

The various exemplary embodiments can be utilized with a wide variety of slot dimensions. In some embodiments, the width w of the slot as measured at the central region can be less than about 50 microns. Other embodiments can have a width of more than about 1000 microns. Various other embodiments can have a width that falls between these values. In some embodiments, the width can be about 80–130 microns, with one embodiment having a width of about 100 microns. The total length of the slots, including the central and terminal regions can be from less than about 300 microns to about 50,000 microns or more.

Figure 9:
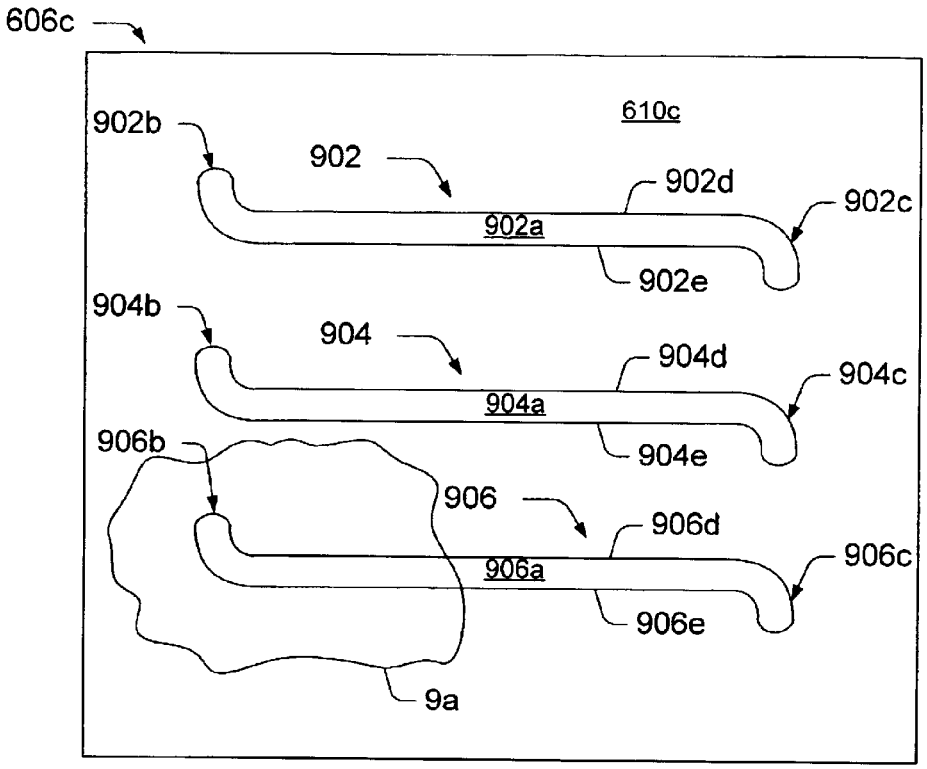
FIG. 9 shows a top view of an exemplary substrate in accordance with one exemplary embodiment.

FIG. 9 shows a first surface 610*c* of another exemplary slotted substrate 606*c*. This exemplary embodiment shows three slots (902, 904, and 906) formed in the substrate. Generally, the slots are labeled according to the nomenclature assigned in relation to FIG. 8. For example, slot 906 comprises a central region 906*a*, and two terminal regions 906*b* and 906*c* respectively. In this embodiment, the terminal regions are generally sickle-shaped. The central region can be comprised, at least in part, by two sidewalls (labeled as 902*d*–906*d* and 902*e*–906*e* respectively). Some of the exemplary sickle-shaped slots can maintain a generally uniform slot width for the entire length of the slot. Such a configuration can be advantageous for some slot formation techniques, as will be discussed in more detail below. As shown in this embodiment, the sickle-shaped terminal region generally extends oppositely from a long axis of the slot when compared to the opposing sickle-shaped terminal region; such need not be the case however.

Figure 9A:
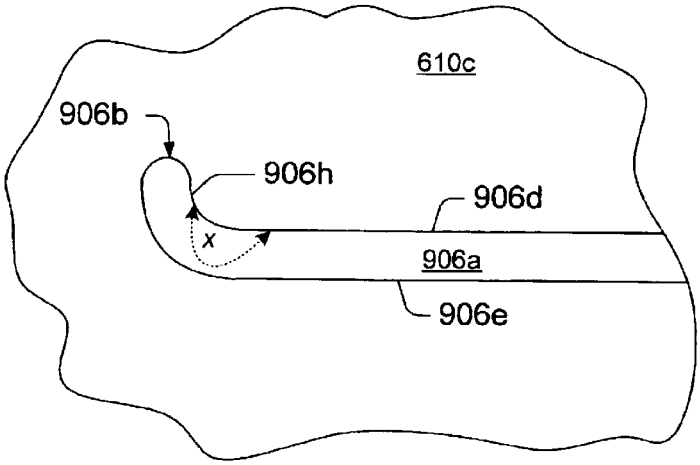
FIG. 9*a* shows an expanded view of a portion of the exemplary substrate shown in FIG. 9.

FIG. 9*a* shows an expanded view of a portion of slot 906 that can show the representative features of FIG. 9. In this embodiment, the sidewalls 906*d* and 906*e* are generally parallel to one another. The terminal region 906*b* can have a portion 906*h* that extends away from both of the sidewalls 906*d* and 906*e*. Viewed another way, this portion of the terminal region lies at an angle x that is greater than 180 degrees relative to at least one sidewall of the central region 906*a*. Further portions of the terminal region can also extend away from the sidewalls (906*d* and 906*e*), in addition to, or alternatively to, the portion shown here.

Figure 10:
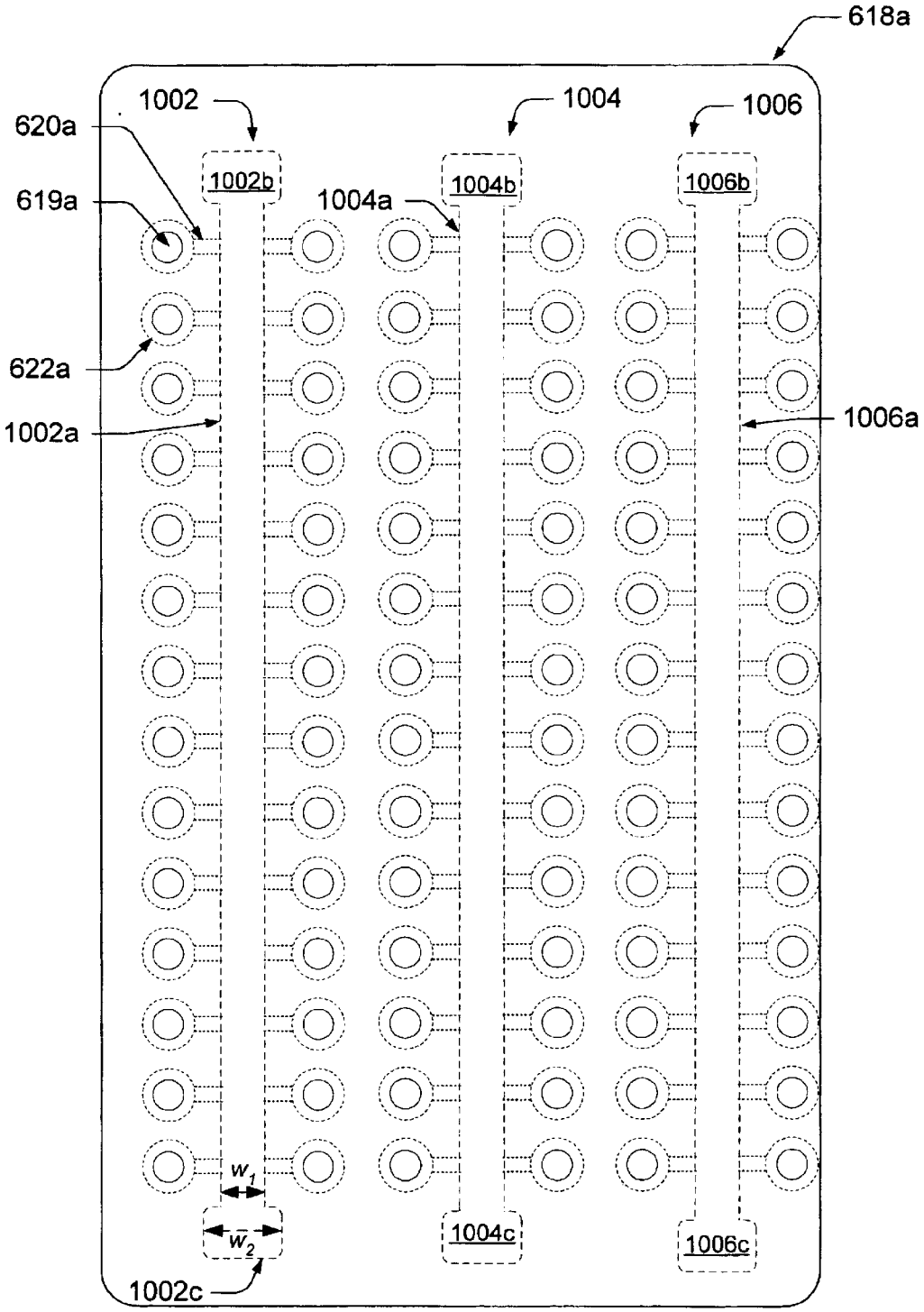
FIG. 10 shows a top view of an exemplary print head in accordance with one exemplary embodiment.

FIG. 10 shows a view from above an orifice plate 618*a* that contains multiple nozzles 619*a*. Several underlying structures can be seen in dashed lines. The underlying structures can include three ink feed slots 1002, 1004 and 1006, multiple ink feed passageways (feed channels) 620*a*, and multiple firing chambers 622*a*. These underlying structures can ultimately supply ink that can be ejected from the nozzles in the orifice plate. Though this embodiment shows the firing chambers and corresponding nozzles being approximately equal distances from the slot, other exemplary configurations can use, among others, a staggered configuration that can allow more firing chambers to be positioned along a given slot length. Additionally, the substrate can have a greater or lesser number of firing chambers and associated structures than the number shown here.

As shown in this embodiment, the slots can comprise a central region "a" and two terminal regions "b" and "c" consistent with the nomenclature described above. For example, slot 1002 can comprise a central region 1002*a* and two terminal regions 1002*b* and 1002*c*. As shown in this topside view, the central region can approximate a generally rectangular shape or configuration, though other shapes can also be utilized. In this embodiment, the terminal regions can also have a generally rectangular shape. The central region can have a width $w_1$ that is less than a width $w_2$ of the terminal region, where the width of the terminal region and central region are taken along directions that are essentially parallel.

As shown in this embodiment, the firing chambers are positioned only proximate to the central region of the slots, though other exemplary embodiments can position firing chambers around more, or less, of an individual slot.

Though the embodiments described so far have had terminal regions that are geometrically similar, other exemplary embodiments can have other suitable configurations. For example, an exemplary slot can have one terminal region that is generally circular and an opposing terminal region that is generally rectangular. Alternatively or additionally, the terminal regions can have many exemplary geometrical shapes or configurations beyond those shown here. For example, exemplary terminal regions can have a teardrop or an elliptical shape among others. Further, although the illustrated embodiments show the terminal regions to be generally centered along a long axis of the slot, such need not be the case. For example, other exemplary embodiments can have one or more of the terminal regions that are offset from the long axis of the slot.

Exemplary Methods

Figure 11:
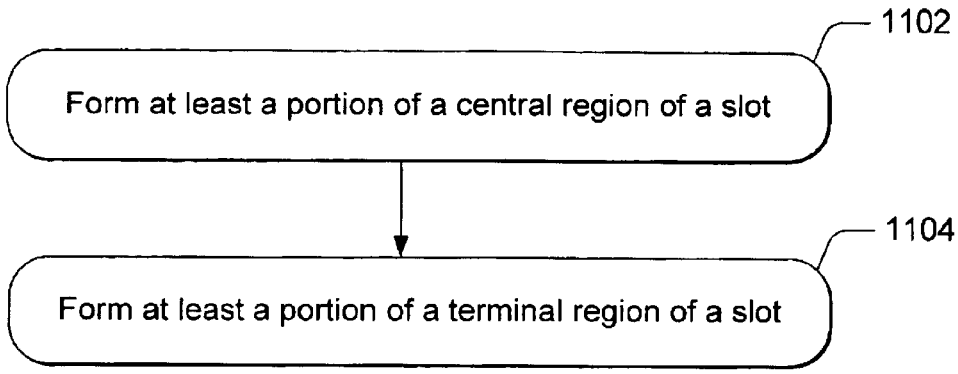
FIG. 11 shows a flow chart of exemplary acts in accordance with one exemplary method.

FIG. 11 is a flow diagram describing a method for forming exemplary slotted substrates. This exemplary method forms at least a portion of a central region of a slot into a substrate, as indicated at 1102. Various exemplary substrates are described above. The central region can be defined, at least in part, by two sidewalls. In one exemplary embodiment, the two sidewalls can comprise a pair of sidewalls that lie along individual planes that define a space therebetween.

In addition to the central region, the method can form at least a portion of a terminal region as indicated at 1104. The terminal region can join, or be contiguous with, the central region. In one embodiment, at least one terminal region of the slot portion can be defined by a sub-region that lies outside of the space between the planes.

In another embodiment, the terminal region can comprise a terminal sidewall, at least a portion of which extends away from both sidewalls of the central region.

In one embodiment, the portion of the central region and/or the terminal region(s) can be formed starting at a surface of the substrate and progressively removing additional substrate material until the portions pass through the substrate to form a slot. Some exemplary embodiments can form the terminal region(s) concurrently with the central region while other embodiments can form the terminal region(s) before or after the central region.

The slots can be formed using any suitable techniques for removing substrate material such as, but not limited to, sand drilling, laser machining, and etching. In some embodiments, where laser machining forms a slot through the substrate, the slot formation process can be conducted on the substrate prior to some or all of the thin-film layers being added and then subsequently the thin film layers can be added to the substrate. Other embodiments can form some or all of the thin-film layers before forming the slots.

Further exemplary embodiments can form slots by an etching process. Some of these embodiments can form a masking layer on a first surface of the substrate. In one embodiment, the first surface can comprise a backside surface. The masking layer can be patterned to define a described slot pattern. The substrate can then be etched through the patterned masking layer. Some embodiments can achieve an anisotropic slot profile by repeatedly etching and passivating to remove substrate material in a desired shape.

In some embodiments, the rate of etching can be related to, among other factors, the rate at which reactants can be supplied to a reaction area and the rate at which the byproducts can dissipate and/or be removed from the reactive area. The described slot configurations can, among other things, allow more uniform etching rates than can be achieved with previous slot configurations and can reduce the occurrence of substrate material remaining in end portions of the slot. Residual substrate material can increase the propensity of cracking in existing configurations. In some of the described embodiments where the terminal regions have a width or diameter that is greater than a width of the central region, etching can pass through the thickness of the substrate at the terminal regions simultaneously to, or before the central region.

The act of etching can be achieved with standard etchants such as, but not limited to, SF6 (sulfur hexafluoride) and TMAH (tetramethylammoniumhydroxide). Passivating or masking can be achieved with standard compounds such as, but not limited to, C4F8 (Octafluorocyclobutane). Further detail regarding etching can be found in U.S. patent application Ser. No. 09/888975 "Slotted Substrate and Slotting Process", filed Jun. 22, 2001 and U.S. Pat. Nos. 5,387,314 and 5,441,593 among others.

In some embodiments, the etching process can be started from the backside and will stop on the thin-film side. This can allow the slots to be formed with the thin-film layers in place. In some embodiments, the etchant can be applied to the substrate for a given amount of time. This can be followed by applying a passivating compound to the sidewalls. These acts can be repeated as desired to form an anisotropic slot profile.

Other exemplary embodiments can combine slot formation techniques. For example, laser machining can be used to form the desired slot shape into the backside of a substrate. The laser can be used to remove the slot shape or portion for less than the entirety of the thickness of the substrate. Etching steps can subsequently be applied to finish the slot formation process. This can allow laser machining to be utilized without concern that the thin-film layers will be damaged by the laser. Other exemplary configurations can use other combinations or "hybrid" processes to form the exemplary slots.

Conclusion

The described embodiments can form a slotted substrate that can have a reduced propensity to crack. The slotted substrate can be incorporated into a printhead die and/or other fluid ejecting devices. The exemplary slots formed in the substrate can supply ink to firing chambers positioned proximate the slot. The exemplary slot construction and formation techniques can reduce stress concentrations that can cause substrate cracking and ultimately lead to a failure of the die. By reducing the propensity for the substrate to crack, the described embodiments can contribute to a higher quality, less expensive product.

Although the invention has been described in language specific to structural features and methodological steps, it is to be understood that the invention defined in the appended claims is not necessarily limited to the specific features or steps described. Rather, the specific features and steps are disclosed as preferred forms of implementing the claimed invention.

What is claimed is:

1. A print head comprising:

a slot received in a substrate between a first substrate surface and a second substrate surface, the slot having a central region and one or more terminal regions, the slot extending along a long axis that does not intersect the first surface or the second surface and that extends through at least a portion of the central region and the one or more terminal regions, the central region extending, at least in part, along a pair of sidewalls, and individual terminal regions being defined by a terminal sidewall at least a portion of which extends away from both sidewalls of the central region.

2. The print head of claim 1, wherein the one or more terminal regions comprises two terminal regions.

3. The print head of claim 2, wherein portions of each of the terminal regions extend away from both sidewalls of the central region.

4. The print head of claim 1, wherein individual sidewalls of the pair of sidewalls are generally parallel to one another.

5. The print head of claim 1, wherein at least a portion of the terminal sidewall is generally perpendicular to both sidewalls of the central region.

6. The print head of claim 1, wherein at least a portion of the terminal sidewall extends arcuately away from both sidewalls of the central region when viewed from above a first substrate surface.

7. The print head of claim 1, wherein individual terminal regions are generally circular when viewed from above a first substrate surface.

8. The print head of claim 1, wherein individual terminal regions are generally rectangular when viewed from above a first substrate surface.

9. A print cartridge incorporating the print head of claim 1.

10. The print head of claim 1, wherein the long axis is parallel to the first and second surfaces.

11. A slotted substrate for use in a fluid ejecting device comprising:

a substrate; and a slot received in the substrate and extending between a first substrate surface and a second substrate surface, the slot having a central region and two or more terminal regions, the central region extending at least in part along a pair of sidewalls, individual terminal regions being defined by a terminal sidewall at least a portion of which extends away from both sidewalls of the central region, wherein the two or more terminal regions are terminally joined with a common sidewall, and wherein the central region and the at least two terminal regions are oriented such that an axis can pass through the central region and at least two of the terminal regions without intersecting either of the first substrate surface or the second substrate surface.

12. The slotted substrate of claim 11, wherein at least a portion of an individual terminal sidewall is generally perpendicular to both sidewalls of the central region.

13. A structure comprising:

a substrate extending between a first surface and a generally opposing second surface;

a slot portion received in the substrate and extending along a long axis which is generally parallel to the first and second surfaces, the slot portion having a central region and a pair of terminal regions through which the long axis passes without intersecting either of the first and second surfaces; and, the central region extending along a pair of sidewalls that lie along individual planes that are generally parallel, the planes defining a space therebetween, and at least one terminal region of the slot portion being defined, at least in part, by one or more sub-regions that lie outside of the space between the planes.

14. The structure of claim 13, wherein the slot portion comprises a slot that extends entirely through the substrate.

15. The structure of claim 13, wherein individual sub-region lie on opposite sides of the planes.

16. The structure of claim 13, wherein the terminal regions are generally circular when viewed from above the first surface.

17. A print cartridge incorporating the structure of claim 13.

18. A print head comprising:

a substrate extending between a first surface and a generally opposing second surface; and a slot received in the substrate and having a central region and a pair of terminal regions, and wherein a line extending through the first and second surfaces can pass through the central region without passing through individual terminal regions, the central region extending along a pair of sidewalls which extend between the first surface and the second surface and that lie along individual planes that are generally parallel, the planes defining a space therebetween, and at least one terminal region of the slot being defined, at least in part, by one or more sub-regions that lie outside of the space between the planes.

19. A print cartridge incorporating the print head of claim 18.

20. A slotted substrate comprising:

a substrate extending between generally opposing first and second surfaces;

a slot received in the substrate and extending along a long axis which does not intercept either of die first and second surfaces, the slot having a central region and one or more terminal regions through which the long axis extends, the central region extending, at least in part, along a pair of sidewalls, and individual terminal regions being defined by a terminal sidewall at least a portion of which extends away from a sidewall of the central region at an angle of greater than 180 degrees.

21. The slotted substrate of claim 20, wherein the portion of the terminal sidewall is planar.

22. The slotted substrate of claim 20, wherein the portion of the terminal sidewall is arcuate.

23. A print cartridge incorporating the slotted substrate of claim 20.

24. A fluid ejecting device incorporating the slotted substrate of claim 20.

25. A substrate having fluid handling slots comprising:

a substrate;

a slot portion received in the substrate between first and second surfaces, the slot portion having a central region and a pair of terminal regions, and extending along an axis passing through the central region and the terminal regions without intersecting the first and second surfaces;

the central region extending along a pair of sidewalls that lie along individual planes that are generally parallel, the planes defining a space therebetween; and, at least one terminal region of the slot portion being defined at least in part by one or more sub-regions that lie outside of the space between the planes, and wherein the terminal regions are generally sickle-shaped.

26. A fluid ejecting device comprising:

a substrate having a thickness defined by generally opposing first and second surfaces; and one or more fluid feed slots received in the substrate, wherein individual fluid feed slots include a central region that is defined in at least the first surface by generally opposing side walls, and wherein individual fluid feed slots are further defined by two generally opposing terminal regions extending alone the first surface from two ends of the central region, wherein each of the terminal regions is generally circular in shape and each has a diameter greater than a width between the generally opposing aide walls.

27. The fluid ejecting device of claim 26, wherein the diameter of the terminal region is at least about 2 times the width between the generally opposing sidewalls.

28. A slotted substrate for use in a fluid ejecting device comprising:

a substrate;

a slot received in the substrate and having a central region and one or more terminal regions contiguous with the central region;

the central region having a width taken generally orthogonal to a long axis of the slot; and, individual terminal regions being defined by a radius of curvature that is greater than one half of the width of the terminal region.

29. The slotted substrate of claim 28, wherein the radius of curvature is greater than or equal to the width of the central region.

30. A printing device comprising, at least in part, a slotted substrate formed in accordance with the method of claim 28.

31. A print cartridge comprising, at least in part, a slotted substrate formed in accordance with the method of claim 28.

* * * * *

UNITED STATES PATENT AND TRADEMARK OFFICE

CERTIFICATE OF CORRECTION

PATENT NO. : 6,938,985 B2
APPLICATION NO. : 10/601150
DATED : September 6, 2005
INVENTOR(S) : Thomas H. Ottenheimer et al.

It is certified that error appears in the above-identified patent and that said Letters Patent is hereby corrected as shown below:

In column 10, lines 27-28, in Claim 15, delete “sub-region” and insert -- sub-regions --, therefor.

In column 10, line 56, in Claim 20, delete “die” and insert -- the --, therefor.

In column 12, line 1, in Claim 26, delete “alone” and insert -- along --, therefor.

In column 12, line 5, in Claim 26, delete “aide” and insert -- side --, therefor.

Signed and Sealed this

Twenty-eighth Day of July, 2009

John Doll

JOHN DOLL
*Acting Director of the United States Patent and Trademark Office*